US007882822B2

(12) United States Patent
Cobb, Jr. et al.

(10) Patent No.: US 7,882,822 B2
(45) Date of Patent: Feb. 8, 2011

(54) METHOD FOR DRIVING AN ELECTROMAGNETIC ACTUATOR IN A DIAPHRAGM CARBURETTOR FOR CONTROL OF AIR/FUEL RATIO

(75) Inventors: William T. Cobb, Jr., St. Petersburg, FL (US); Massimo Casoni, Modena (IT)

(73) Assignee: Selettra S.R.L., Bentivoglio (BO) (IT)

( * ) Notice: Subject to any disclaimer, the term of this patent is extended or adjusted under 35 U.S.C. 154(b) by 683 days.

(21) Appl. No.: 11/873,829

(22) Filed: Oct. 17, 2007

(65) Prior Publication Data

US 2008/0197309 A1 Aug. 21, 2008

Related U.S. Application Data

(60) Provisional application No. 60/852,004, filed on Oct. 17, 2006.

(51) Int. Cl.
*F02M 7/24* (2006.01)

(52) U.S. Cl. ..... 123/438; 123/434; 123/437; 261/23.2; 261/38

(58) Field of Classification Search ..... 123/361, 123/434, 437, 438; 261/23.1, 23.2, 38
See application file for complete search history.

(56) References Cited

U.S. PATENT DOCUMENTS 4,318,869 A * 3/1982 Stoltman ..... 261/50.1
7,770,559 B2 * 8/2010 Cobb, Jr. ..... 123/360
2008/0191368 A1 * 8/2008 Cobb ..... 261/36.2

* cited by examiner

*Primary Examiner*—Stephen K Cronin
*Assistant Examiner*—J. Page Hufty
(74) *Attorney, Agent, or Firm*—Browdy and Neimark, PLLC

(57) ABSTRACT

Method for driving an electromagnetic actuator in a diaphragm carburettor for control of air/fuel ratio foresees at least the following steps:

associating an electromagnetic actuator in a diaphragm carburettor for control of air/fuel ratio with the current generation device in an internal combustion engine;

driving the aforementioned electromagnetic actuator with pulses suitable for generating the force necessary to actuate the actuator;

generating said drive pulses of the actuator in the moments when the current pulses of the aforementioned current generator are such that the maximum current is available during the cycle of the motor.

12 Claims, 3 Drawing Sheets

FIG.3
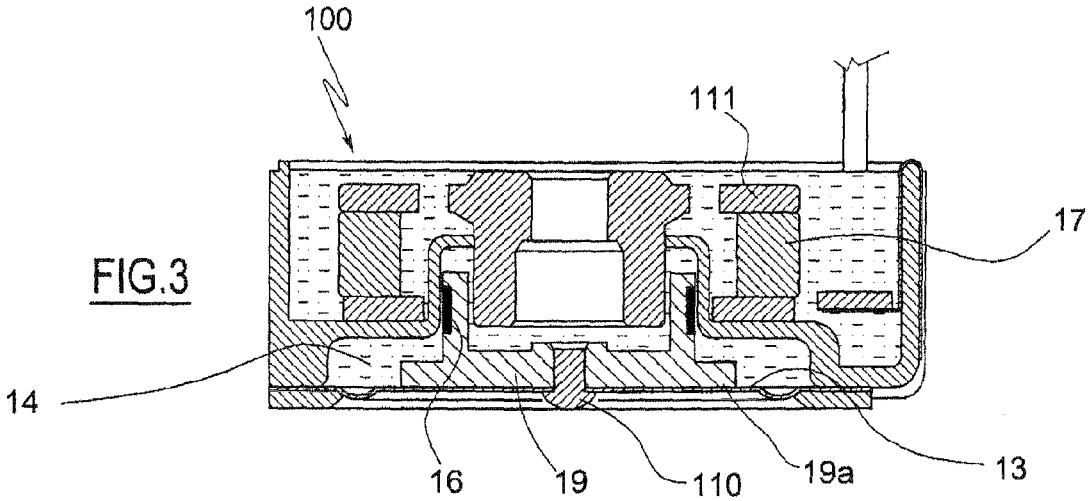
FIG.4
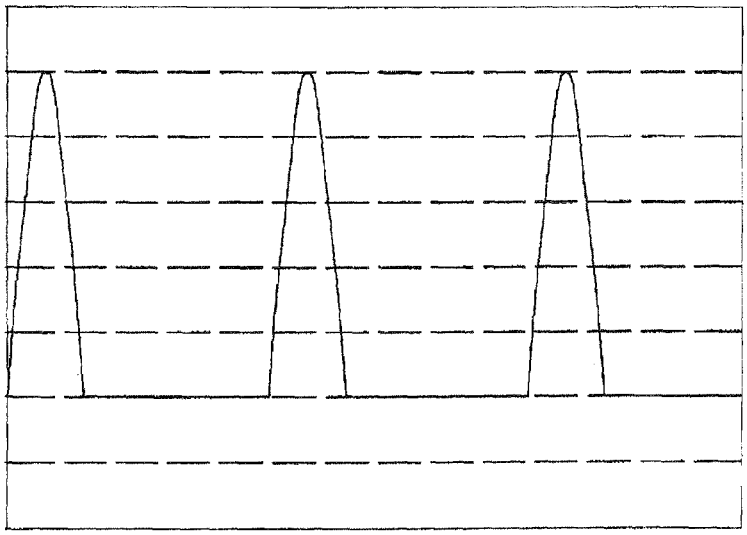
A
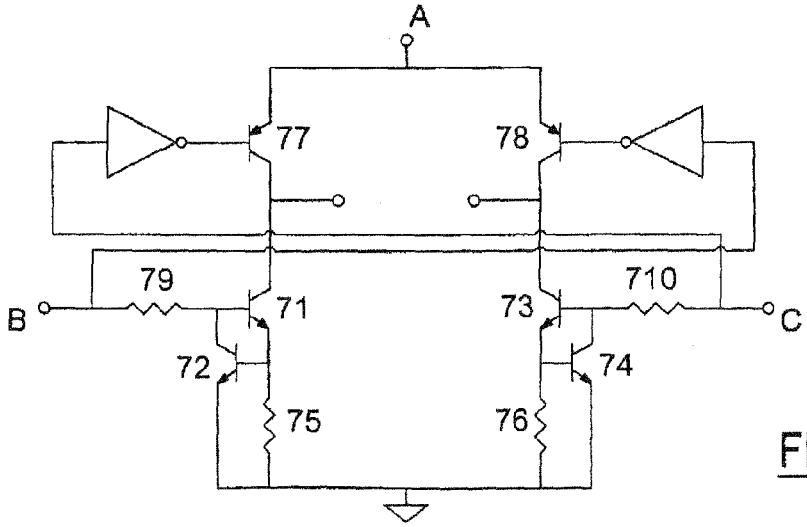
FIG.7

METHOD FOR DRIVING AN ELECTROMAGNETIC ACTUATOR IN A DIAPHRAGM CARBURETTOR FOR CONTROL OF AIR/FUEL RATIO

TECHNICAL FIELD

The present invention refers to a method for driving an electromagnetic actuator in a diaphragm carburettor for control of air/fuel ratio.

More specifically, the present invention refers to a method for driving an actuator suitable for controlling the air/fuel ratio of a diaphragm carburettor through the action of the diaphragm dispenser, like for example an electromagnetic actuator with mobile coil, also known as voice coil. However, the method can also be used to control other types of actuators such as solenoids acting directly in the fuel line or in the air intake line of a diaphragm carburettor or in a conventional float carburettor.

BACKGROUND ART

As known, electrical actuators can be actuated with different methods. They can be actuated continuously through a direct current, so as to have a constantly controlled force in the case of voice coil actuators, and a retention force and a constant actuation time in the case of solenoid actuators. They can be actuated by a pulse width modulation (PWM) signal. In actuation methods with PWM, the actuator is actuated with a fixed high frequency guide signal and the duration of the pulses is varied to control the actuation force of the actuator or its retention force. If the response time of the actuator is high compared to the frequency of the PWM signal, the response of the actuator is that of dampening the signal so as to give a similar response to that which can be obtained with a direct current signal modifier. Another actuation method is similar to the one used in the operation of electroinjectors, in which the actuator is actuated by a single pulse of variable duration to control the opening time of the injector.

SUMMARY OF THE INVENTION

The carburettor system according to the finding derives from the fact that, especially when it is applied to a single-cylinder motor or to a single cylinder of a multi-cylinder motor, it is only active during a portion of rotation of the motor. Specifically, such an operation, in a two-stroke motor, takes place during the rising step of the piston and close to the top dead centre (TDC), in a four-stroke motor it takes place during the descent of the piston in the motor intake step.

Therefore it is particularly advantageous to actuate the actuator only during these periods of operation of the motor.

In applications for small motors the ignition system and also the current generation system, which are usually used to actuate the actuator of the carburettor system, consist of fixed coils and magnets fixed onto the rotary flywheel of the motor that interact with fixed coils at the crankcase.

The current generated by the current generation system is usually limited, especially at low rotation speeds of the motor.

Moreover, the current provided by the magnetic field that passes through the coil is available in a specific orientation of the flywheel and of the motor, and only for brief fractions of the rotation cycle of the motor.

However, in known applications the current provided by the coil and available to actuate the actuator at the same time as the desired actuation period of the feed requires the preliminary storage of the energy generated by the recharge coil, with the consequent undesired need to have expensive and bulky storage condensers in the actuation circuits.

Moreover, the control of the forces and therefore of the actuation current, generally requires complex analogue circuits, and can lead to not-repeatable behaviour, due to the mechanical production and electrical tolerances.

The purpose of the present invention is to provide a method for driving an electromagnetic actuator in a diaphragm carburettor for control of air/fuel ratio that is able to overcome the aforementioned drawbacks of the prior art.

DISCLOSURE OF THE INVENTION

Such a purpose is accomplished through a method for driving an electromagnetic actuator in a diaphragm carburettor for control of air/fuel ratio, in accordance with claim 1.

The dependent claims outline preferred and particularly advantageous embodiments of the method according to the invention.

Further characteristics and advantages of the invention shall become clearer from reading the following description, provided as an example and not limiting purposes, with the help of the figures illustrated in the attached tables.

BRIEF DESCRIPTION OF DRAWINGS

FIG. 3 shows a section view of an actuator applied to a dispensing device of a diaphragm carburettor, to be used in the method according to the present invention;

FIG. 4 represents a diagram illustrating a signal representative of the actuation force of the actuator of FIG. 3;

FIG. 7 represents an example of a pilot circuit relative to the method of the invention.

BEST MODE FOR CARRYING OUT THE INVENTION

Figure 1:
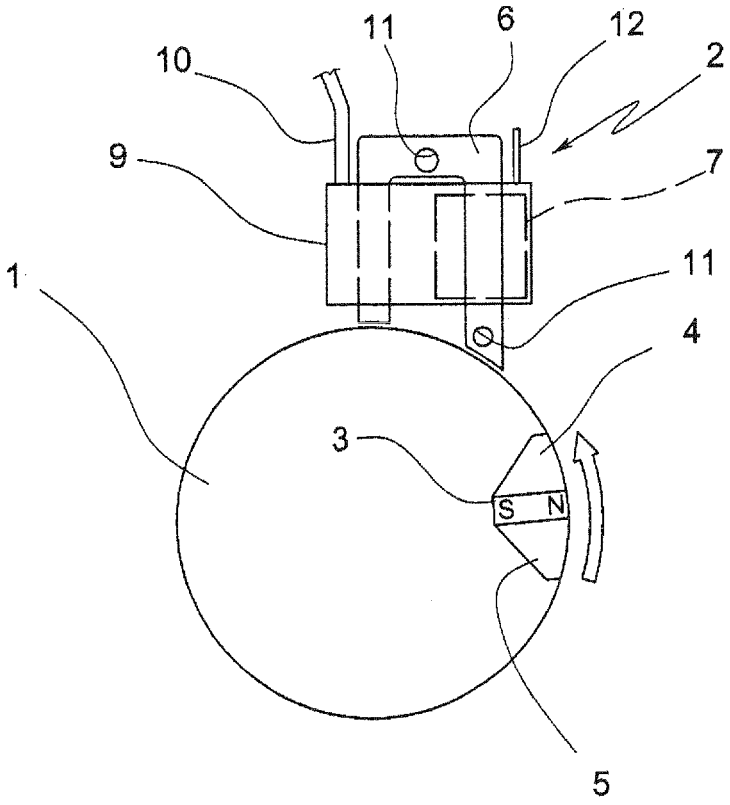
FIG. 1 illustrates a typical current generation system according to the prior art to be used in association with the method for driving an electromagnetic actuator in a diaphragm carburettor for control of air/fuel ratio, according to the present invention.

FIG. 1 shows a typical current generation system for small portable motors. It comprises a flywheel 1 with a permanent magnet 3 fixed onto the edge and arranged between two polar expansions 4 and 5. The polar expansions 4, 5 convey the magnetic flow generating a pair of North-South magnetic poles.

A magnetic circuit comprising a core of stampings 6 and a winding 7 magnetically coupled with it is fixed onto the fixed part, normally at the cylinder or at the motor casing through a pair of screws.

These parts usually have a plastic body 9 wound around them and the internal circuits are protected from humidity, oil and vibrations. In most cases, an electronic circuit and a high voltage transformer are also included in order to supply power to the spark plug through cables 10. In this case, there is also a crank pin 12 that, connected to an outer button, allows sparking to be inhibited to shut down the motor.

When the motor is operating, and any time the polar expansions 4, 5 face the core of stampings 6, a voltage is induced in the winding 7 by the change in flow inside it.

Figure 2:
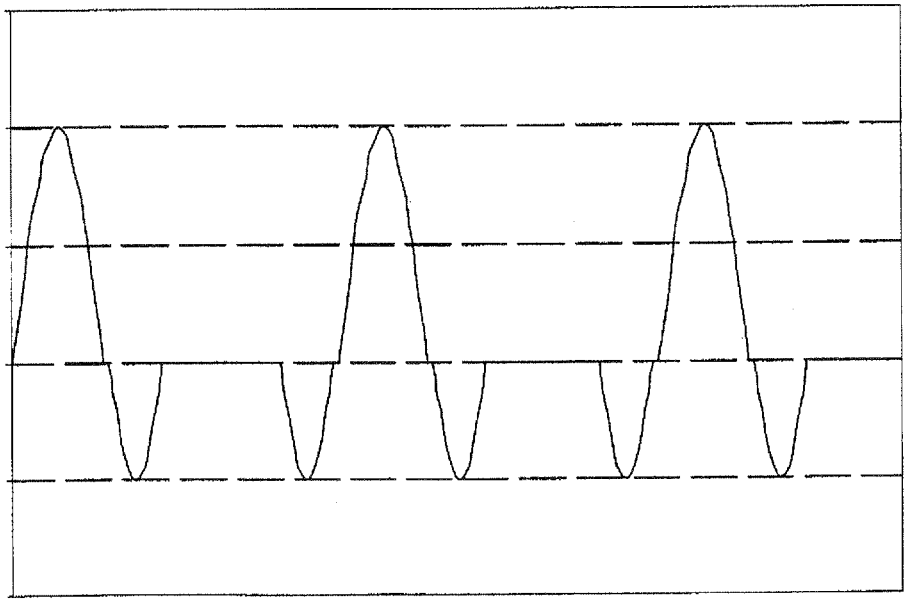
FIG. 2 represents a diagram illustrating the voltage signal generated by the winding of the current generator of FIG. 1.

An example of the voltage signal generated in the winding is shown in FIG. 2.

The signal is only generated from when the expansion 4 goes opposite the first arm of the core of stampings 7 (right hand side in FIG. 1), until the expansion 5 leaves the second arm (left hand side in FIG. 1). It is clear that for a wide angle of rotation of the flywheel voltage is not generated in the winding, since there is no variation in flow inside of it.

A series of positive and negative pulses coming from the fixed winding are generally generated around the top dead centre (TDC) of the motor. Some of them are used not only to generate current, but also to take care of some steps concerning ignition control. In order to have the maximum efficiency and minimum emissions, in common two or four stroke motors, the injected air/fuel load must be ignited a few degrees before the top dead centre (TDC). The phasing of the signals of the winding with the TDC is obtained through reference marks suitably cut on the flywheel and on the casing, which ensure the fixed and unequivocal position of the flywheel with respect to the crankshaft.

As already stated, also in diaphragm carburettors the pressure pulse peaks are close to the TDC, both for two stroke and for four stroke motors.

FIG. 3 illustrates an actuator applied to the dispenser device of a diaphragm carburettor, which adopts the method according to the present invention.

The actuator 100 comprises a movable coil 16 directly fixed to the diaphragm 13, which separates the chamber 14 at constant pressure from the dispensing chamber of the carburettor, and a fixed magnetic field generator, in the example a permanent magnet ring 17 associated with field guides 111. The passing of current through the coil 16 generates an actuation force applied to the diaphragm the position of which regulates the dispenser of the carburettor so as to influence the dispensing of fuel to the motor.

The inversion of the direction of the flow of current generates a force in the opposite direction on the diaphragm 13, and the actuator 100 is thus able to generate a force in both directions on the diaphragm 13, by simply inverting the polarity of the coil 16.

In particular, the coil 16 is wound on a support 19 made from light plastic and shaped like a cup with a base 19*a* fixed, through a rivet 110, centrally to the diaphragm 13 itself, on the side of the chamber at constant pressure 14.

The coil 16 is positioned with its central axis perpendicular to the surface of the diaphragm 13 and centrally with respect to the dispensing chamber of the carburettor.

In the example, the head of the rivet 110 projects into the dispensing chamber of the carburettor so as to act as a thrusting head on the end of a lever in contact with the diaphragm 3.

The electrical connections with the coil 16 can be made in accordance with the prior art.

Again for illustrative purposes, we note that FIG. 4 represents a diagram illustrating a mark representative of the actuation force of the actuator of FIG. 3.

Figure 5:
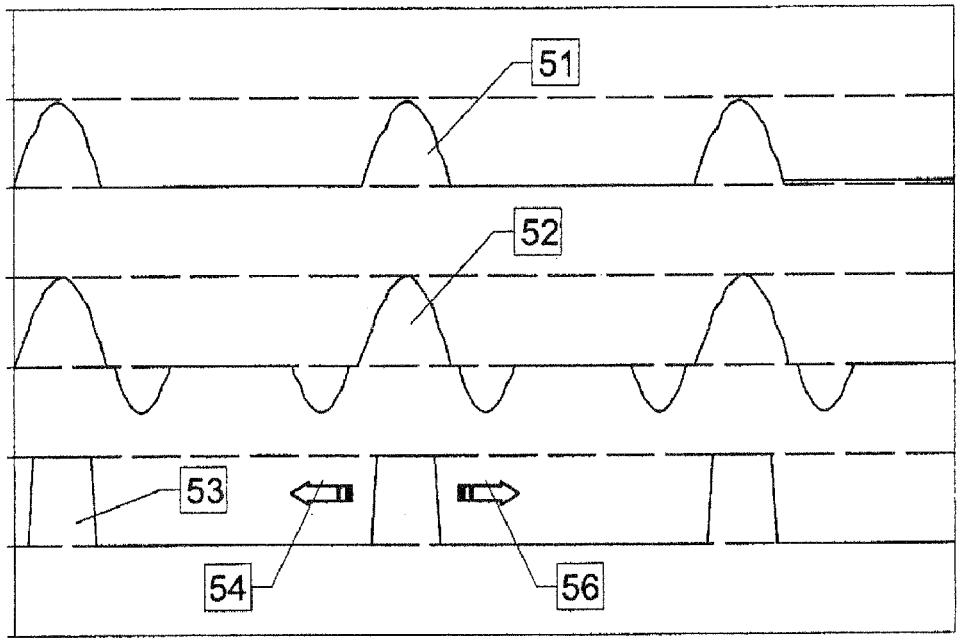
FIG. 5 represents a diagram illustrating the coordination of the phases of different signals, according to the present invention.

According to the present invention one or more pulses of the winding 7, preferably those of greater size, and indicated with 52 in FIG. 5, are phased with the pulses 51 transmitted to the diaphragm from the coil 16, which are the dispenser actuation pulses.

The pulses of the winding 7 can be used to generate both the force necessary to actuate the actuator, generating correctly phased signals, and the current for the ignition circuit, if required. A plurality of different windings 7 can be made for both arms of the core, to satisfy such requirements in the most efficient and/or advantageous way.

The diaphragm 53 in FIG. 5 shows the current pulse generated to actuate the coil actuator. It is correctly phased both with the pulse 51 transmitted to the diaphragm, and with one of the voltage pulses 52 of the winding 7, when the maximum current is available during the cycle of the motor.

According to the invention a method for driving the fuel dispenser is therefore defined that is suitable for correctly dispensing the amount of fuel to the motor, and therefore the amount of fuel that passes through the needle valve. In the method of the invention the current, and therefore the force, are constant during the duration of the actuation pulse transmitted to the diaphragm. The amount of fuel is dispensed by changing the phase and/or duration of the pulse.

In particular, the amount of fuel can be varied by varying the phase of the actuation pulse of the actuator during the activation phase of the actuation pulse, or else during the deactivation phase of the actuation pulse or even by exploiting both the activation and deactivation phases of the actuation pulse. The duration of the pulse can be regulated through an electronic control, for example the arrows 54 and 55 show how such a duration can be modified. The additional correction force exerted by the actuator on the diaphragm dispenser is used for a variable time within the natural intake pressure pulse according to the reference signals, allowing precise dispensing of the fuel to be injected into the motor.

Preferably, the actuator used, for example the one described with reference to FIG. 3, is selected to be sufficiently fast exploiting its low mechanical and electrical inertia.

Figure 6:
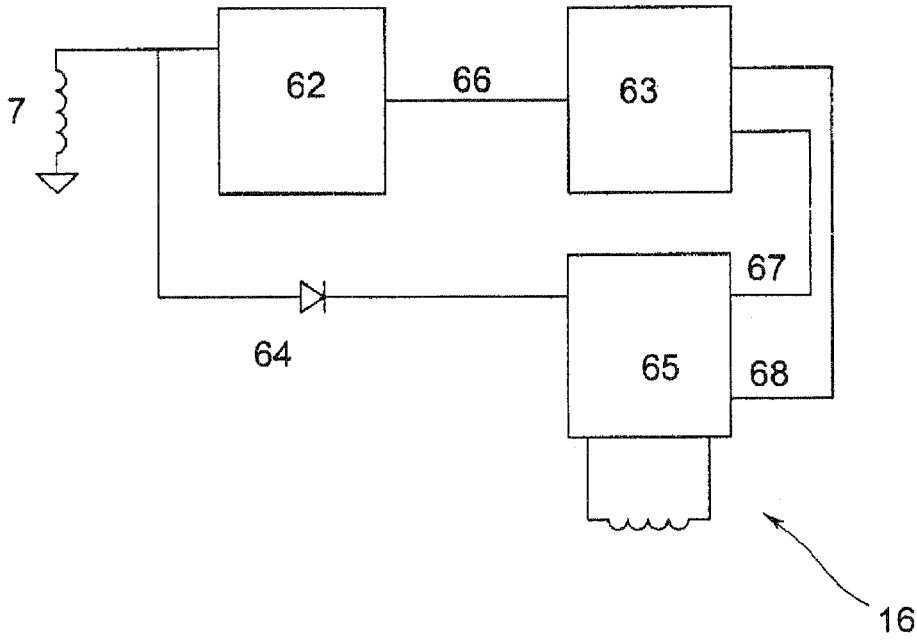
FIG. 6 shows a simplified block diagram of the control system, in accordance with the present invention.

FIG. 6 shows a simplified block diagram of the control system, in accordance with the present invention.

The winding 7 in the example generates both the actuation energy and the phase relationships for the control unit.

The voltage generated by 7 is supplied to the control block 65 in point A passing through a rectifying diode 64.

The voltage is also supplied to a conditioning circuit 62 that sends a digital signal 66 to the control unit 63.

The unit 63, which comprises a microcontroller, uses the signal as reference phase.

The control unit 63 generates two guide signals 67 and 68 directed towards the control block 65 in points B and C respectively.

In the example the two digital signals 67, 68 are able to direct the currents, and therefore the forces of the actuator to respectively push and pull the dispenser diaphragm, so as to be able to enrich or dilute the mixture.

This can be achieved with the voice coil actuator, according to the present invention, by simply inverting the direction of the current. Since at least three logic conditions are required by the actuator (ON-Push, ON-Pull, OFF), at least two binary lines are necessary to carry them out. If, on the other hand, only one actuation direction is necessary, the ON/OFF conditions can be carried out with a single line, Finally, the control block 65 is connected to the actuator through the connections indicated with D and E.

An example of a control circuit is given in FIG. 7.

It represents a configuration in parallel, where the external connections have the same reference numerals as FIG. 6. Four control transistors 71, 73, 77 and 78 determine the current that passes through the external actuator connected to terminals D and E. Terminal A is connected to the positive pole of the feeder. The transistors are controlled through the external signals B and C by the control unit and follow the following truth table:

| B Input | C Input | D Output | E Output | NOTES |
|---|---|---|---|---|
| Low | Low | Floating | Floating | All control transistors are OFF. There is no current flow |
| Low | High | Vcoil | 0 V | The current of the actuator flows from D to E (D positive) |
| High | Low | 0 V | Vcoil | The current of the actuator flows from E to D (E positive) |
| High | High | NA | NA | Not permitted |

A further current limitation circuit is added with the components indicated with 72, 75, 79 and 74, 76, 710 in FIG. 7. There are two identical blocks that limit the sink current in the transistors 1 and 3, so as to have a fixed current as described for the invention.

The described invention has numerous and great advantages.

Firstly, we note that the current provided by the coil is available to actuate the actuator at the same time as the desired actuation period of the power supply.

Thanks to this fact, the preliminary storage of the energy generated by the recharge coil is not necessary, thus eliminating the need to have expensive storage condensers in the actuation circuits or, at the least, substantially reducing the size and cost thereof. Moreover, since the actuation period is correctly "positioned" during the injection cycle, the efficiency in use of the actuator is optimised. In this way, a minimal energy can be used for the operation of the control.

Further advantages are made clearer by the following considerations. The current generated in the recharge coil depends upon various factors including the relative position of the magnets with respect to the recharge coil, the rotation speed of the flywheel and the space between the magnets fixed to the flywheel and the core of the recharge coil. The correct choice for such arrangements thus allows a power supply with an extremely variable voltage and current. This allows various possibilities in the control of the actuator to actuate it with a direct current or with a PWM signal that can vary over its entire width. Therefore, the voltage must be regulated at a constant value or else be sampled and the corrections must be made for their variable characteristics.

Basically, thanks to the invention, through the positioning of the driver close to the voltage generation point, a high actuation voltage can be ensured, and therefore the command signal of the actuator can be controlled by simply using a current limitation circuit of the actuation source and by varying the actuation force through the variation in duration of the current signal. Since both for voice coil actuators and for solenoids the actuation forces are a direct function of the actuation currents, a constant and limited actuation current ensures behaviour of the fuel dispenser that can be repeated as closely as possible.

Since the position and the speed of the motor can be easily identified in the generation of the current signal by the recharge circuit, controlling the starting time and the duration of the actuation pulse of the control actuator is very easy.

The control obtained with the method of the invention is carried out with high precision.

This mainly derives from the fact that such actuation pulsation has a constant size, whereas the fuel dispenser is controlled by its phasing and/or duration. Indeed, it is known that phasing and/or time checks can be carried out simply and precisely with a digital electronic circuit, whereas an analogue check of the size of the actuation current requires expensive and less precise digital/analogue converters, as well as reference voltages and/or conditioning circuits.

Of course, a man skilled in the art can make numerous modifications and variations to the method for driving an electromagnetic actuator in a diaphragm carburettor for control of air/fuel ratio described above, in order to satisfy contingent and specific requirements, all of which are also covered by the scope of protection of the invention, as defined by the following claims.

The invention claimed is:

1. Method for driving an electromagnetic actuator in a diaphragm carburettor for control of air/fuel ratio, characterised in that it foresees the following steps:

associating an electromagnetic actuator in a diaphragm carburettor for control of air/fuel ratio with the current generation device in an internal combustion engine;

driving the aforementioned electromagnetic actuator with pulses suitable for generating the force necessary to actuate the actuator;

generating said drive pulses of the actuator in the moments when the current pulses of the aforementioned current generator are such that the maximum current is available during the cycle of the motor.

2. Method for driving an electromagnetic actuator, according to claim 1, in which the amount of fuel is dispensed by varying the phase of the actuation pulse of the actuator, through electronic control regulation.

3. Method for driving an electromagnetic actuator, according to claim 2, in which the amount of fuel is dispensed by varying the phase of the actuation pulse of the actuator during the activation step of the actuation pulse.

4. Method for driving an electromagnetic actuator, according to claim 2, in which the amount of fuel is dispensed by varying the phase of the actuation pulse of the actuator during the deactivation step of the actuation pulse.

5. Method for driving an electromagnetic actuator, according to claim 2, in which the amount of fuel is dispensed by varying the phase of the actuation pulse of the actuator both during the activation step, and during the deactivation step of the actuation pulse.

6. Method for driving an electromagnetic actuator, according to claim 1, in which the amount of fuel is dispensed by varying the duration of the actuation pulse of the actuator.

7. Method for driving an electromagnetic actuator, according to claim 1, in which the pulses of the current generator are used both to generate the force necessary to actuate the actuator, and to generate current for the ignition circuit.

8. Method for driving an electromagnetic actuator, according to claim 1, in which the actuation current and force of the actuator are kept constant during the duration of the actuation pulse.

9. Method for driving an electromagnetic actuator, according to claim 1, in which an additional correction force exerted by the actuator on the diaphragm dispenser is used for a variable duration within the natural intake pressure pulse according to the reference signals, so as to allow precise dispensing of the fuel to be injected into the motor.

10. Method for driving an electromagnetic actuator, according to claim 1, in which a microcontroller control device is used that is suitable for generating two guide signals directed to a control block to generate forces suitable for respectively pushing or pulling the dispenser diaphragm of the aforementioned actuator so as to be able to enrich or dilute the mixture.

11. Method for driving an electromagnetic actuator, according to claim 10, in which said actuator is a voice coil actuator or else a solenoid actuator.

12. Microcontroller control device suitable for being used to actuate the method according to claim 1, characterised in that it foresees a conditioning circuit for generating a signal for a microcontroller unit, where the aforementioned microcontroller unit is suitable for generating at least two guide signals to be directed towards a control block to generate forces suitable for respectively pushing or pulling the dispenser diaphragm of the aforementioned actuator so as to be able to enrich or dilute the mixture.

* * * * *